US006231643B1

(12) United States Patent
Pasic et al.

(10) Patent No.: US 6,231,643 B1
(45) Date of Patent: May 15, 2001

(54) MEMBRANE ELECTROSTATIC PRECIPITATOR

(75) Inventors: Hajrudin Pasic; Md Khairul Alam; David J. Bayless, all of Athens, OH (US)

(73) Assignee: Ohio University, Athens, OH (US)

( * ) Notice: Subject to any disclaimer, the term of this patent is extended or adjusted under 35 U.S.C. 154(b) by 0 days.

(21) Appl. No.: 09/554,895

(22) PCT Filed: Jun. 9, 1999

(86) PCT No.: PCT/US99/12978

§ 371 Date: May 19, 2000

§ 102(e) Date: May 19, 2000

(87) PCT Pub. No.: WO99/65609

PCT Pub. Date: Dec. 23, 1999

Related U.S. Application Data

(60) Provisional application No. 60/089,640, filed on Jun. 17, 1998.

(51) Int. Cl.[7] ..... B03C 3/76; B03C 3/78

(52) U.S. Cl. ..... 95/75; 95/76; 96/36; 96/44; 96/66; 96/69

(58) Field of Search ..... 96/32, 44, 66, 96/69; 95/75, 76

(56) References Cited

U.S. PATENT DOCUMENTS

| | | | | |
|---|---|---|---|---|
| 1,479,271 | | 1/1924 | Wolcott | 95/70 |
| 3,748,828 | * | 7/1973 | Lefebvre | 96/44 X |
| 4,035,886 | | 7/1977 | Gluck | 445/67 |
| 4,058,377 | | 11/1977 | Schminke et al. | 96/93 |
| 4,086,646 | * | 4/1978 | Lanese | 96/32 X |
| 4,239,514 | | 12/1980 | Junkers | 96/87 |
| 4,276,056 | | 6/1981 | Pasic et al. | 95/76 |
| 4,321,067 | | 3/1982 | Gupner et al. | 96/74 |
| 4,441,897 | | 4/1984 | Young et al. | 96/36 |
| 4,604,112 | | 8/1986 | Ciliberti et al. | 55/302 X |
| 5,114,442 | * | 5/1992 | Artz | 96/32 X |
| 5,137,546 | | 8/1992 | Steinbacher et al. | 95/71 |
| 5,582,632 | | 12/1996 | Nohr et al. | 96/69 X |

* cited by examiner

*Primary Examiner*—Richard L. Chiesa
(74) *Attorney, Agent, or Firm*—Jason H. Foster; Kremblas, Foster, Millard & Pollick

(57) ABSTRACT

A membrane is used as a collection substrate in an electrostatic precipitator (ESP). Possible material choices include fibers in the form of woven mats, screens made from stainless steel wires or fiber reinforced polymer composite membranes. The membranes have a tensile bias applied during operation, and have impulse tensile force applied during a dust removal step. By combining a dry ESP membrane field with wet-film cleaning field, it may be possible to improve collection efficiencies both by reducing turbulence and eliminating re-entrainment losses due to rapping. Through implementation of new materials that resist hostile ESP environments, the invention enhances the possibility of using novel technologies, such as pulsed corona and others, suitable for removal of molecules such as $NO_x$ and $SO_x$, which is very important for meeting proposed PM2.5 EPA emissions regulations.

27 Claims, 6 Drawing Sheets

Fig. 11
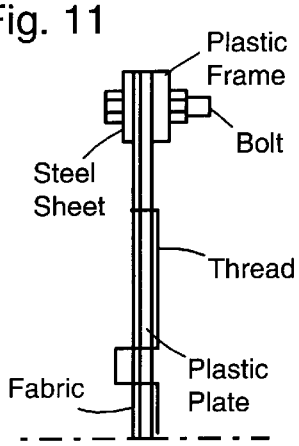
Fig. 12
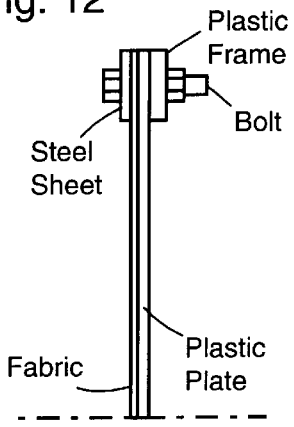
Fig. 13
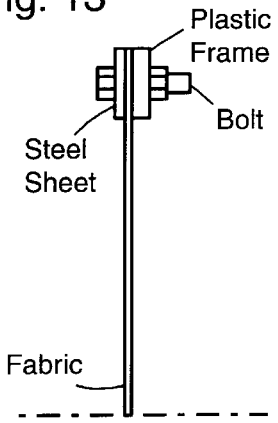
Fig. 14
| Number | Voltage (*kV*) | Current (*mA*) | Time (*min*) | Dust Thickness (*mm*) | Dust Dropped in First Slot (*g*) | Total Collected Dust, Including Dropped (*g*) | Relative Humidity | Percentage of Dropped Dusts |
|---|---|---|---|---|---|---|---|---|
| 1 | 85 | 0.35 | 25 | 1-4 | 5 | 19.34 | 52% | 26% |
| 2 | 85 | 0.3 | 25 | 1-4 | 5.05 | 25.07 | 52% | 20% |
| 3 | 85 | 0.4 | 25 | 1-4 | 5.09 | 25.11 | 49% | 20% |
| 4 | 85 | 0.4 | 25 | 1-4 | 5.34 | 25.36 | 48% | 21% |
| 5 | 85 | 0.35 | 25 | 1-4 | 6.37 | 26.39 | 52% | 24% |
| Aver | 85 | 0.36 | 25 | 1-4 | 5.37 | 24.25 | 50.6% | 22% |

Fig. 15

| Number | Voltage (kV) | Current (mA) | Time (min) | Dust Thickness (mm) | Dust Dropped in First Slot (g) | Total Collected Dust (g) | Relative Humidity |
|---|---|---|---|---|---|---|---|
| 1 | 85 | 0.3 | 25 | 1-3 | 0 | 31.71 | 54% |
| 2 | 85 | 0.3 | 25 | 1-4 | 0 | 29.49 | 54% |
| 3 | 85 | 0.3 | 25 | 1-4 | 0 | 25.97 | 54% |
| 4 | 85 | 0.3 | 25 | 1-4 | 0 | 29.14 | 54% |
| 5 | 85 | 0.3 | 25 | 2-4 | 0 | 30.75 | 54% |
| Aver. | 85 | 0.3 | 25 | 1-4 | 0 | 29.41 | 54% |

Fig. 16

| Voltage (kV) | Current (mA) | Time (min) | Dust Thickness (mm) | Dust Dropped in First Slot (g) | Total Collected Dust (g) | Relative Humidity |
|---|---|---|---|---|---|---|
| 40 | 0.1 | 25 | 1-3 | 0 | 32.06 | 49% |
| 50 | 0.25 | 25 | 1-3 | 0 | 29.02 | 52% |
| 60 | 0.3 | 25 | 1-4 | 0 | 41.09 | 52% |
| 70 | 0.4 | 25 | 1-3 | 0 | 47.58 | 50% |
| 80 | 0.35 | 25 | 1-3 | 0 | 42.96 | 50% |

MEMBRANE ELECTROSTATIC PRECIPITATOR

CROSS-REFERENCE TO RELATED APPLICATION

This application claims priority of Patent Cooperation Treaty Application No. PCT/US99/12978 filed Jun. 9, 1999, which claims priority of U.S. Provisional Application No. 60/089,640 filed Jun. 17, 1998.

BACKGROUND OF THE INVENTION

1. Field Of The Invention

This invention relates generally to electrostatic precipitators (ESPs) used to precipitate particulate matter from exhaust gases onto collection substrates by electrostatic charge, and more specifically relates to the collection substrates (collecting electrodes).

2. Description Of The Related Art

Industrial electrostatic precipitators (ESPs) are used in coal-fired power plants, the cement industry, mineral ore processing and many other industries to remove particulate matter from a gas stream. ESPs are particularly well suited for high efficiency removal of very fine particles from a gas stream. Specially designed ESPs have attained particle collection efficiencies as high as 99.9%. However, conventional ESP collection efficiencies are at their lowest values for fine particle sizes between 0.1–1.0 $\mu$m. Additionally, conventional ESPs cannot address the problem of gaseous emissions or gas-to-particle conversion.

In 1997 the Environmental Protection Agency (EPA) proposed new air quality standards for fine particulate matter. The focus of the regulations is the emissions of fine particulate, i.e., particles below 2.5 $\mu$m in diameter (PM2.5). These particles more readily enter the human respiratory system.

In a typical conventional ESP, vertical wire electrodes are placed in the midsection of a channel formed between vertical parallel collector substrates. The heavy, typically steel, plates are suspended from a support structure that is anchored to an external framework. Commonly, ten of the single precipitation channels constitute a single field. Industrial precipitators have three or more fields in series. An example of such a structure is shown and described in U.S. Pat. No. 4,276,056, 4,321,067, 4,239,514, 4,058,377, and 4,035,886, which are incorporated by reference.

A DC voltage of about 50 kV is applied between the wire electrodes (discharging electrodes) and the grounded collector plates (collecting electrodes), inducing a corona discharge between them. A small fraction of ions, which migrate from the wires towards the plates, attach to the dust particles in the exhaust gas flowing between the plates. These particles are then forced by the electric field to migrate toward, and collect on, the plates where a dust layer is formed.

In dry ESPs, the dust layer is periodically removed from dry ESPs by hammers imparting sharp blows to the edges of the plates, typically referred to as "rapping" the plates. When ESPs are rapped, the dust layer is supposed to drop vertically downward from the plates due to a shear force between the plate and the parallel dust layer. However, due to initial imperfections and in-plane compressive forces, plates tend to buckle when rapped as shown in FIG. 5. The compressive loading in this so-called normal-rapping mode generates fast propagating stress waves, along and across the plate, that are manifested in large lateral amplitudes (displacements) of the plates in the direction normal to the plate surface.

Several complications result from the rapping process. Due to buckling of the plates, imparting a force on the plate will cause some of the dust to be expelled away from the plate. This dust may then be re-entrained into the gas flow, where it may or may not be removed by downstream collection plates. The disruption of the ash layer caused by the rapping force, combined with buckling of the plate, tends to break the ash layer into small pieces. Smaller ash pieces are more susceptible to re-entrainment than large pieces, which tend to stay in the laminar boundary layer of gas flow that exists next to the collection plate and then slide down into the collection hopper.

Conventional collector plates are stiffened with ribs aligned along the direction of hammer impact force to reduce buckling and stresses and fatigue of the plates. These ribs support the plates during rapping to reduce the amplitude of plate vibrations that cause dust to be broken into clouds. However, such ribs greatly decrease the smoothness of the gas flow through the channels. It is highly desirable that the gas flow between collector plates be uniform. Turbulence can decrease collecting efficiency several times and will result in a less uniform layer thickness. Turbulence causes some of the dust that is broken into a cloud to continue along in the gas stream, and this dust is re-entrained into the gas stream.

Dust that re-entrains into the gas flow stream as a result of rapping in the upstream fields may be re-precipitated in the downstream fields. However, dust precipitated on the most downstream field in dry ESPs does not enjoy this privilege, and therefore re-entrainment occurring at this field becomes a critical factor in the overall collection efficiency of the dry ESP.

Studies on full-scale dry precipitators suggest that re-entrainment of fly ash due to rapping accounts for 30% of the time averaged penetration for cold-side units and as much as 60% for hot-side ones. In the last few decades, driven by regulations requiring mass collection efficiencies on the order of 99.8% and higher, the design of precipitators has evolved towards units of much larger specific collection areas and higher cost. For that reason the issue of controlling the rapping re-entrainment has become critical. The overall goal of dust rapping should be to efficiently remove the precipitated ash, with minimal re-entrainment.

The problem of rapping to remove the dust layer is formidable. The dust layer can be up to 1 cm thick, and it should detach from the typically 10 m long vertical plate bounding the turbulent gas flow and slide down into hoppers with a low re-entrainment. In order to successfully rap, the dust layer should fracture into pieces which are as large as possible. Furthermore, the pieces should, while falling, remain as close as possible to the plate where they are "hidden" in the gas-flow boundary layer, where the gas flow velocity is low. However, due to buckling and turbulence, rapping tends to result in re-entrainment.

In general, dry ESPs will also have difficulty in meeting the aspects of the PM2.5 standards that relate to gas-to-particle conversion. In gas-to-particle conversion, particles 0.1 $\mu$m or smaller that form from $SO_2$, $NO_x$, and other gaseous materials, grow rapidly by coagulation or nucleation on smaller sites. Particles grow slowly beyond 2 $\mu$m, since diffusional effects are greatly reduced.

There are two reasons dry ESPs are not effective at controlling gas-to-particle conversion. The primary reason is that ESPs using metal collecting plates do not effectively remove gaseous pollutants that coagulate to form the sulfate and nitrate particles. Second, ESPs are inherently less effective in removing particles in the 0.1 to 1.0 mm range, which is in the size range of potential nucleation sites for growth of particles from gaseous material. As a result, dry ESPs do not effectively reduce the source of much of the small particle emissions from power plants, and will have problems meeting the PM 2.5 requirements.

Current work in this field offers the likelihood of converting much $SO_2$ to $SO_3$ inside the ESP by electron attachment. In this process, free electrons are formed in a nanosecond-pulsed corona. A wire electrode is charged, usually via negative DC voltage, in a rapidly oscillating manner. The pulsing enhances the corona effect, ionizing more gas and producing more free electrons for beneficial interaction with $NO_2$ or $SO_2$ molecules. Two mechanisms have been proposed to explain how this process leads to the removal of $SO_2$. One is via direct electron attachment forming a charged $SO_2$ molecule for direct collection. The other is through the formation of $SO_3$ via the formation of ozone, $O_3$. $SO_3$ rapidly forms $H_2SO_4$ (sulfuric acid) via the reaction $H_2O+SO_3 \rightarrow H_2SO_4$. The acidic environment leads to increased corrosion of the steel plates and ductwork. Therefore, electron capture and pulsed-corona techniques will require that collectors be made from materials that resist chemical attack by sulfuric acid.

A different type of ESP, which uses water, is called wet ESP. In such a system, a vertical plate is covered by a film of flowing water passing from the top of the plate to the bottom. The flowing water acts as both the collecting electrode and the ash removal mechanism. Wet electrostatic precipitators offer the advantages of fewer re-entrainment losses, the ability to collect reactive gases and elimination of rapping. However, because of the oxidizing effect of water, the use of metal plates is prevented by the induced corrosion. Disposal of the ash-laden water is also a problem.

In addition to the problem of corrosion associated with wet ESP, the substrate material used to transport the water film has to be consistently and continuously wetted to prevent the formation of "dry spots", which are typical for steel plates in wet ESPs. Otherwise, ash can accumulate on the dry spots and prevent further capture of particulate matter and gases in those regions of the collecting surface.

Any ESP that is expected to be implemented in response to the new EPA requirements should be able to be retrofitted in many industrial applications in which conventional, inefficient ESPs are currently operating. Inexpensive retrofitting of existing dry ESPs to meet the new, increasingly stringent particulate emissions standards is of great interest for a number of industries. In response to those interests, Chang and Altman of EPRI have recently evaluated fine particle control technologies, for particles <2 $\mu$m, and have conducted detailed economic evaluations of retrofit methods for improving the particle control effectiveness of existing ESPs.

Three promising options, all of which are devices added downstream of the existing ESP, have been evaluated. All of them have the potential to reduce particle emissions to <0.01 lb/Mbtu at the stack. A cost analysis of seven combinations indicates that a stand-alone wet ESP retrofit would cost the most (2.5 mills/kWh), while retrofit of the wet ESP into the last field of an existing dry ESP has the lowest cost (1.2 mills/kWh). The retrofitting option also gives a new chance for dry ESPs, which in combination with the wet section (hybrid ESPs) may be used to exploit the best properties of both. For example, a hybrid ESP can optimize particulate collection by using the dry section to remove 95% or more of the particulates, while the wet portion could be used to facilitate the pulse-corona technique and to eliminate the re-entrainment loses. It is clear that hybrid ESPs offer a possibility of reducing the water contamination from wet ESPs to a minimum.

Therefore, the need exists for a lightweight electrostatic precipitation collector substrate that is conductive, resists corrosion due to water and/or acid environments and can be wetted. The collector should also be easily retrofitted to existing ESP systems.

SUMMARY OF THE INVENTION

The invention is a thin membrane collection substrate for use in an electrostatic precipitator. By definition, and in contrast to plates, membranes are structural elements that cannot resist bending and may be loaded in tension only. Membranes may be made from numerous materials depending on applications and the conditions of the ESPs. These include fabric-type woven fibers as well as various composites made from electrically conducting fibers embedded in a thin flexible matrix. The membrane is held in tension (tensile bias) and during rapping in dry ESPs is periodically subjected to a momentarily increased, impulsive tensile force to clear the collected particulates.

An advantage of "pulling" the collection surface rather than "pushing" is that the dust layer will shear off the plate without developing a lateral force that pushes dust back into the gas stream. Further, the use of a membrane allows the implementation of various improvements in ESP operation, including water-based removal of dust layers and applications of novel technologies such as pulsed-corona gaseous pollutant control.

Another application of the membrane is in wet ESPs, where metal plates would be subject to increased corrosion and are not able to maintain a continuously wetted surface. A membrane made of a corrosion resistant weave from thin fibers, with good wetting properties, i.e. which absorbs liquids well, facilitates application of a continuous film of water.

Many advantages result from using membranes. In dry precipitators, re-entrainment losses may be minimized by dust dislodgment via the application of tension during the so-called shear-rapping mode. Further, pre-stretched membranes, if subjected to a sufficiently large tensile loading, are free of the initial imperfections. This and the absence of stiffeners causes a more uniform spacing from the wire electrodes, thereby minimizing short circuits with the charging electrodes, called sparkovers, between the wires and substrates. In the absence of both initial imperfections and buckling—typical of plate collectors in existing ESPs—the dust layer is broken into larger patches, thereby minimizing re-entrainment losses. The absence of stiffeners results in reduced turbulence, which increases collection efficiency and produces more uniform dust layers and current fields. Additionally, lighter membranes develop greater accelerations at lower applied forces, because of the light weight, and therefore are more effective at dislodging the accumulated dust layer. Studies performed in the High-Temperature Gas Dynamics Laboratory at Stanford Universities (see D. Choi at al.: "Experimental Study of Ash Layer Rapping and Re-Entrainment from the Collector Plates of a Laboratory-Scale Electrostatic Precipitator",TR-100055 Research project 533-01, Final Report prepared for EPRI, September 1991) have shown that shear rapping needs 2–4 times lower accelerations, which means lower applied forces, than the normal rapping. This means that higher shear-off strains developed in membrane materials also promote more effective dust dislodgment. Finally, drastically decreased mass of membranes reduces the effort and costs required for installation. transportation, maintenance and service, and reduces overall costs in both retrofit and in new construction applications.

In wet precipitators, re-entrainment of particles may be minimized via water spraying of corrosion-resistant membranes that facilitate wetting in wet and hybrid electrostatic precipitators. Further, the use of membranes in wet precipitators facilitates the implementation of gaseous pollutant removal, such as $SO_2$ and $NO_x$, via pulsed-corona or similar techniques.

The combination of improvements facilitated by the use of membranes could result in smaller precipitators as fewer fields are required due to lower re-entrainment, lower costs, possible combinations of wet and dry precipitators in hybrid systems, and improved ease and efficiency of existing precipitators through low cost retrofitting.

The membrane material used with the present invention in a dry ESP must have sufficient electrical conductivity, must sustain high temperatures, must resist fatigue, must resist corrosion in acid environments, should have good wetting properties if applied in wet and hybrid ESPs, should be light-weight, and should be inexpensive. Depending on the application, the invention allows use of numerous variations in the material used and the choice of the material is not the same for all circumstances. However, a typical example of a material that may find a wide application is a membrane in the form of a woven mat of very thin fibers. The fibers may be made from various materials, including carbon, polymers, silica and ceramics. Other examples could be ultra light composite sheets and wire-based dense screens made from very thin corrosion resistant metal alloys.

Since the membrane material must be corrosion-resistant, the invention opens up the possibility of combining the dry with wet precipitation in hybrid ESPs. A hybrid ESP consists of both dry and wet sections to optimize their advantages. An example is a precipitator with all dry fields followed by a final wet field. Such a facility removes most of the particulate on a dry basis, minimizing the water reclamation needed for the last stage. The last stage, being wet, minimizes re-entrainment losses and can be used with a pulsed-corona system for gaseous pollutant removal.

Membranes allow novel cleaning techniques to be used to remove dust layers, while at the same time increasing collection efficiency and decreasing re-entrainment. This leads to smaller ESPs or more efficient retrofits for existing units. Also, unlike plates, membranes can be subjected to a relatively small force during cleaning, and therefore need no stiffeners. The gas flow is uniform and the particle-collection efficiency should be increased. Increasing uniformity of the dust deposit results in a more uniform current field.

BRIEF DESCRIPTION OF THE DRAWINGS

FIG. 11 is a side view illustrating an alternative connecting structure for the membrane;

FIG. 12 is a side view illustrating an alternative connecting structure for the membrane;

FIG. 13 is a side view illustrating an alternative connecting structure for the membrane;

FIG. 14 is a table containing experimental results for fabric 1150 without the plastic plate;

FIG. 15 is a table containing experimental results for fabric 1150 with the plastic plate; and FIG. 16 is a table containing experimental results for fabric 3COWCA-7;

Figure 1:
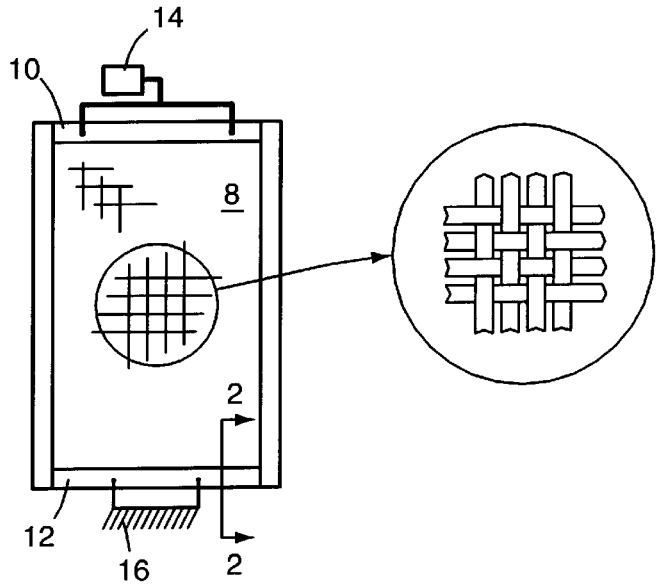
FIG. 1 is a front schematic view illustrating the preferred membrane collector.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

DESCRIPTION OF THE PREFERRED EMBODIMENT

The preferred membrane 8 is shown in FIG. 1. A woven mat of electrically conductive carbon fibers is shown as an example of a material suitable for use as the membrane 8. However, other materials and configurations can be used.

Figure 2:
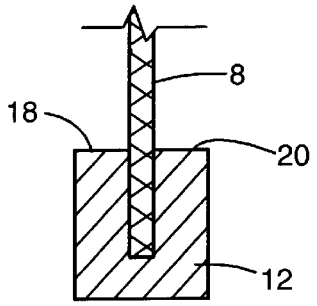
FIG. 2 is a side view in section through the line 2—2 of FIG. 1.

The membrane 8 is held taut during use between an upper frame member 10 and a lower frame member 12. The frame members are preferably rigid fiberglass channel beams having a U-shaped cross section forming a groove as shown in FIG. 2. The upper and lower edges of the membrane 8 are inserted into the grooves of the frame members and are clampingly held, such as between the laterally disposed legs 18 and 20.

Of course, there are innumerable equivalent means for gripping the edge of the membrane to hold it taut. For example, an alternative to the frame members 10 and 12 is a pair of cylinders around which opposite edges of the membrane 8 are wrapped and rotated until the membrane is pulled taut, for example by a pre-programmed servomotor. However, wrapping the membrane around a cylinder may cause fracture of the fibers due to bending, and therefore this structure is less desirable. There are many other devices for holding the membrane taut that are easily understood by a person of ordinary skill in the art from the present discussion.

In its operable position, the membrane 8 is preferably mounted in the path of, and parallel to, the exhaust gases, in substantially the same position that steel collector substrate plates are mounted in conventional dry ESPs. Charged wire electrodes are suspended between pairs of membranes, and the membranes are grounded. An electric field exists between the charged wire electrodes and the membranes.

The lower frame member 12 is mounted to an ESP frame 16, and the upper frame member 10 is mounted to a variable tensile loader 14, such as a servomotor or a hydraulic or pneumatic cylinder, for example. The tensile loader must be variable, which means it must be able to apply forces of at least two different magnitudes to the membrane. The two different magnitudes include the tensile force required to make the membrane taut (called the tensile bias below), and a second, greater magnitude force (called the impulse force below).

Of course, a tensile load can be applied to all four edges of the membrane, if desired. Such multidirectional stretching will provide integrity to the structure, and prevent possibly broken fibers from separating from other, surrounding fibers. The horizontal fibers, when stretched, will allow load transfer, and thereby act like a matrix.

There should be no limitation to the type of tensile loader described herein, because there are many devices that may function as a tensile loader. Essentially, the tensile loader 14 can be any force-generating apparatus that can apply a tensile force to one edge of a membrane. This includes prime movers of all types: hydraulic and pneumatic cylinders, motors (electromechanical, thermomechanical, hydraulic, linear, etc.). Such prime movers can be used alone or in combination with other mechanical structures such as levers, etc. A person of ordinary skill will recognize that there are so many other alternatives to the preferred tensile loader that such alternatives could never be described exhaustively.

Figure 3:
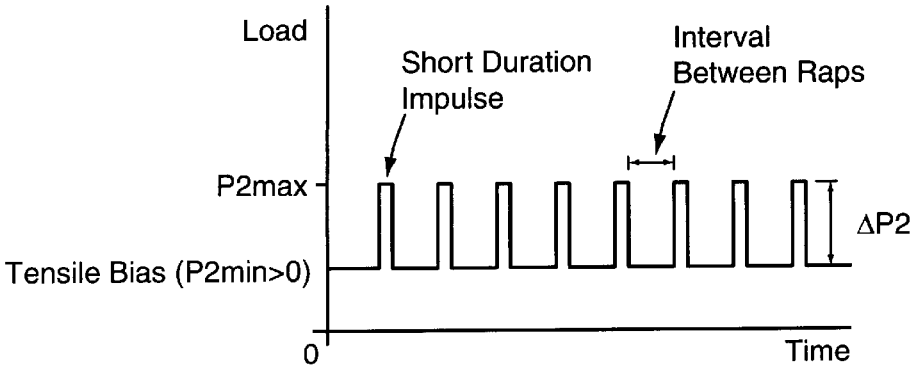
FIG. 3 is a graphical illustration of Load versus Time.

The membrane 8 is held at an initial "tensile bias" by the tensile loader 14 to keep the membrane 8 taut the entire time the ESP collection apparatus is operating. This bias is shown graphically in FIG. 3. The tensile bias straightens and removes essentially any imperfections from the membrane, and causes the distance between the membrane and the discharging electrodes to remain constant. At predetermined rapping-time intervals, the tensile loader is actuated, and the tensile force applied to the membrane is rapidly increased for a brief moment, during an "impulse force." The momentarily increased impulse force is subsequently relieved, relaxing the membrane back to the tensile bias. Impulse forces are applied and relaxed back to the tensile bias periodically during the rapping operation. The intensity and duration of the tensile loading is to be subjected to optimization.

The frequency and duration of impulse forces depends upon many factors, including the rate of dust buildup, which will vary by the position of the membrane in the gas stream. For example, a membrane that is further downstream will have less dust buildup than. a membrane that is upstream, and will therefore require less frequent application of impulse forces.

Application of the periodic impulse forces causes the dust layer to shear from the membrane. Because there is no significant lateral motion of the membrane perpendicular to the plane of the membrane, there is no significant lateral movement of the dust layer and therefore, no significant particulate re-entrainment caused by lateral movement. Additionally, because there is no need for stiffening ribs on the membranes, the flow of gas through and around the membranes is more uniform. Any dust that is separated from the collecting surface will not experience turbulent gas flow. In the absence of initial imperfections and buckling, the dust layer breaks off in large pieces in the gas-stream boundary layer of little turbulence. Therefore, the dust pieces dislodged in the shear mode will slide down the membrane and fall into the hoppers below, minimizing the re-entrainment losses.

The use of a membrane has many advantages over plates. While the difference between a woven membrane and a plate is easily defined, because the woven mat behaves as a plate with infinitely many hinges that cannot transmit bending moments, the difference between the membrane and a thin solid plate may be difficult to define. A qualitative description of a membrane is "a sheet that offers a negligible resistance to either bending or in-plane compression." In contrast, a plate possesses bending stiffness and resists both bending and in-plane compression in a manner similar to beams in bending. This resistance to bending is what keeps a plate from buckling under its own weight.

When a plate bends, a portion of the cross-section undergoes tension and the remaining portion on the opposite side of the neutral axis undergoes compression. On the contrary, in membranes the complete cross-section is loaded in tension only. This state of stress is called "membrane stress" and is the only stress that exists in true membranes, such as fabrics, and thin sheets of rubber.

Consequently, if not supported, a vertical "ideal" membrane, such as a woven mat made from thin fibers or wires buckles due to its own weight, irrespective of its length. Thus, membranes differ from plates inasmuch as membranes buckle under their own weight, but plates do not.

By having such a limp, substantially zero-stiffness membrane, all the initial imperfections that cause problems in a stiff plate are removed by preloading the membrane with the tensile bias. The tensile bias straightens the membrane, providing an essentially planar surface on both sides which have predetermined and fixed positions relative to the other ESP elements. The application of tensile impulse forces then strains the planar membranes, shearing the dust layer off.

Confusingly, a solid sheet of metal can be viewed either as a plate or a membrane, depending upon its dimensions and material properties. The following analysis establishes a more precise description of the distinction between solid membranes and plates for the purposes of defining the term "membrane."

A vertical cantilever planar structure clamped at its lower end buckles under its own weight whenever its vertical length, 1 exceeds the critical value given by $$l_c = \sqrt[3]{\frac{5\pi^2 EI}{6q}} = 0.88\sqrt[3]{\frac{Eh^2}{\rho}} \tag{1}$$

where E is Young's modulus, I is moment of inertia of a cross section, h is the thickness and q is a specific weight per unit length. See S. Timoshenko, J. Gere: Theory of Elastic Stability, McGraw-Hill, N.Y., 1961, page 104.

Because "ideal" membranes have a zero stiffness EI, the critical buckling length is equal to zero. However, given the thickness h and width b, if the critical length, $1_c$ is small in comparison with the width b such that $1_c/b < 5$ the length and width are no longer of the same order. That the length and width are of the same order is required by the geometrical definition of a membrane, which is that the in-plane dimensions in any two mutually perpendicular directions (length and width) are of the same order of magnitude, but the third dimension (thickness) is at least an order of magnitude less than the other two. If the length and width are not of the same order, the structure resembles a narrow horizontal strip, rather than a membrane. Hence, if the critical length, $1_c$ is so small that $$l_c = 0.88\sqrt[3]{\frac{Eh^2}{\rho}} \leq \frac{b}{5} \tag{2}$$

then the stiffness of the solid sheet is negligible. Therefore, based on Equation (2), if the thickness of a sheet satisfies the criterion $$h \leq 0.1078\sqrt{\frac{\rho b^3}{E}} \tag{3}$$

or is very close to this value, the sheet is defined as a membrane.

For illustration, Equation (3) predicts that a planar steel structure (E=210GPa,ρ=7.8 g / cm$^3$) whose width b is 2, 3 or 4 m will behave as a membrane if its thickness h is less than 0.19, 0.34 and 0.52 mm respectively. Hence, solid plates in the existing precipitators cannot be viewed as membranes because their thickness is at least a few millimeters. Since the ratio ρ/E for aluminum alloys is the same as for steels, the same respective thickness is obtained for that material as for steels. If the sheet of the same width is made from Kevlar 49 (E/ρ=0.86×10$^6$ m), for example, it will behave as a membrane if its thickness is less than 0.33, 0.60 and 0.93 mm.

Figure 4:
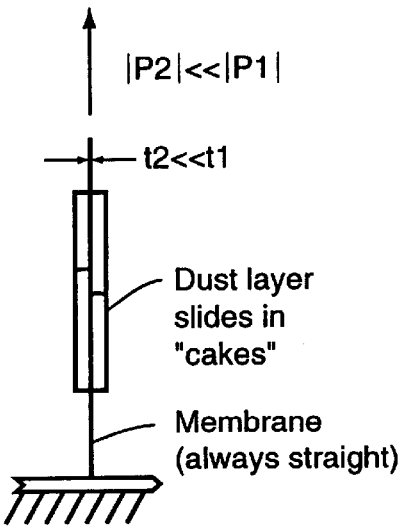
FIG. 4 is a side schematic view of the shear mechanism of the present invention.
Figure 5:
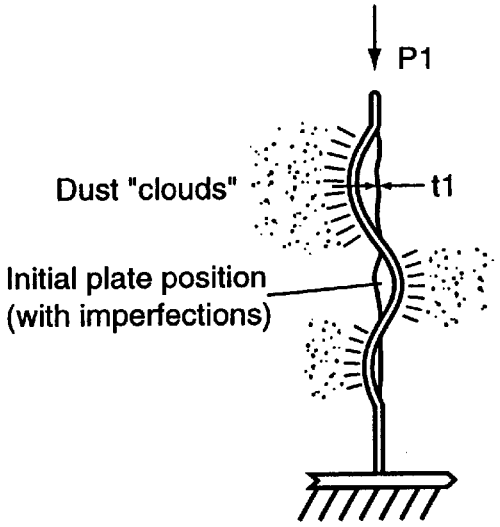
Fig. 5 (Prior Art)
FIG. 5 is a side schematic view of the lateral motion of conventional plates during rapping.

There are several advantages that arise from the use of a membrane as a collection substrate in an ESP. The dust dislodgment mechanism of stretched membrane collectors differs significantly from the one in existing ESPs with rapped plates. The shear mechanism for membranes is illustrated schematically in FIG. 4. In order to eliminate initial imperfections, the membrane is subjected to a tensile bias. As mentioned above, the membranes are periodically subjected to an additional impulse force ΔP that is large enough to produce accelerations capable of removing ash deposits by shearing action. This shear mechanism involves rapidly straining the membrane relative to the dust layer, which is negligibly strained. The impulse force is applied to the edge of the membrane in the membrane's plane relative to the parallel dust layer. The tensile force produces a shear force between the membrane and the dust layer. The shear force separates the dust layer from the membrane, causing the dust layer to slide downwardly into a hopper.

The membrane material must posses sufficient resistance to tearing and other forms of fracture to withstand the tensile forces necessary to produce shear between the dust layer and the membrane. However, the membrane should also have a relatively low stiffness to provide higher shear-off strains.

In addition to the advantage of the shear mechanism of membranes, other advantages are also derived from the lower mass of membranes. Of course, the lower mass will facilitate the ease of collecting surface installation and transportation of new construction, as well as reduce the cost of the retrofit or repair. However, the lower mass of the membrane will also result in increased accelerations when applying the same impulsive force used to clear the attached dust layer. In fact, as mentioned earlier, a comparison of shear-rapping mode to conventional normal-rapping mode shows that the former is superior and requires 2–4 times smaller accelerations, and therefore 2–4 times smaller applied forces, given the same mass, than the normal rapping mode. Clearly the use of much lighter membranes, combined with the need for 2 to 4 times smaller accelerations, makes it possible to optimize the rapping technology in order to achieve a better efficiency.

Figure 6:
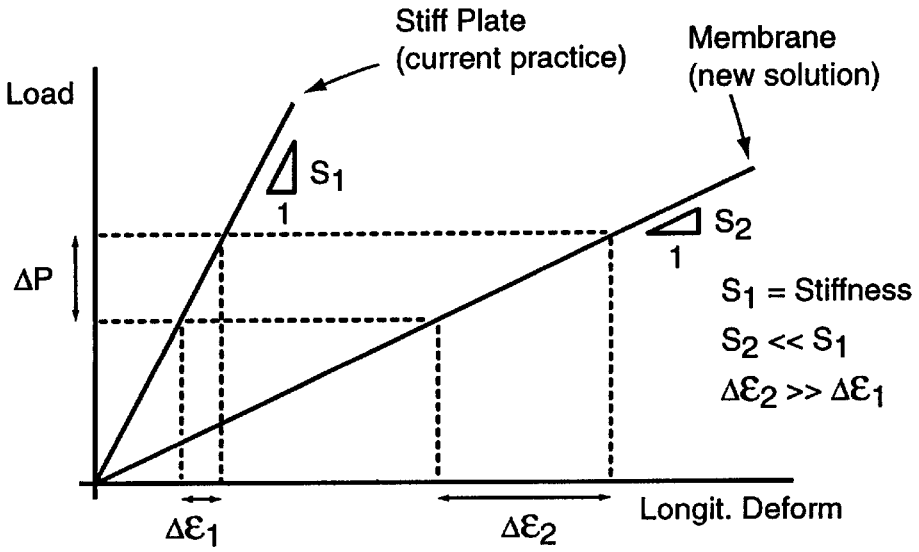
FIG. 6 is a graphical illustration of Load versus Longitudinal Deformation.

Comparison between the current practice and the invention is illustrated in FIG. 6. As is apparent, even high-intensity forces applied to conventional steel plates produce relatively small shear-off strains. The same or larger strains may be achieved with much smaller forces if much less stiff, and lower mass, membranes replace conventional plates.

The analysis of the acceleration advantage is as follows. As an example, the longitudinal vibration of a uniform rod to an axial force f(x,t)=Pδ(x)$\bar{u}$(t) in the form of a unit-step (impulsive) function of time $\bar{u}$(t) of magnitude P applied at x=0 is $$u(x,t) = \frac{1}{2}\frac{P}{mL}t^2 + \frac{P}{EAL}\left[\frac{(L-x)^2}{2} - \frac{1}{6}L^2\right] - \frac{2PL}{\pi^2 EA}\sum_{r=1}^{\infty}\frac{1}{r^2}\cos\frac{r\pi x}{L}\cos\omega_r t \tag{4}$$

where m is a unit mass, L is the rod's length, E is Young's modulus, A is the cross sectional area, t is time and $u(x,t)$ is displacement, while $$\omega_r = \frac{r}{\pi}\sqrt{\frac{EA}{mL^2}} \tag{5}$$

is the natural frequency in the r-th mode. The first term in Equation (4) represents the rigid body motion and the second term may be viewed as the static deformation around which the vibration takes place.

The longitudinal deformation ε(x,t)=∂u/∂x and acceleration a(x,t)=∂$^2$ u/∂t$^2$may be found from Equation (5). After performing the differentiation and retaining the leading terms only, the conclusion is that $$\varepsilon \cong \frac{P}{EA}a \cong \frac{P}{m} \tag{6}$$

Both the plate and membrane are assumed to have the same length L and width w, and the turbulence effects of plate stiffeners are disregarded. If the thicknesses are $t_P$ and$t_M$, the intensities of applied forces are $P_P$, $P_M$ and the mass densities $\rho_P$, $\rho_M$. The subscripts P and M stand for "plate" and "membrane". It is further assumed that the above conclusion for the rod applies for plates and membranes as well, which is a good approximation for large enough w. Therefore strains and accelerations in the membrane and the plate relate as:

$$\frac{\varepsilon_M}{\varepsilon_P} = \frac{P_M}{P_P}\frac{E_P}{E_M}\frac{t_P}{t_M} \tag{7}$$

$$\frac{a_M}{a_P} = \frac{P_M}{P_P}\frac{\rho_P}{\rho_M}\frac{t_P}{t_M} \tag{8}$$

Similarly, the frequencies are related as $$\frac{\omega_M}{\omega_P} = \sqrt{\frac{E_M}{E_P}\frac{\rho_P}{\rho_M}\frac{t_M}{t_P}} \tag{9}$$

The density ratio of steel plate and carbon fiber, for example, used in a membrane is typically $\rho_P/\rho_M$4. Assuming that the carbon fibers are chosen such that $E_P/E_M$≈1 and $t_P/t_M$=4, we find from Equations (7), (8) and (9) that $$\frac{\varepsilon_M}{\varepsilon_P} = 4\frac{P_M}{P_P},\ \frac{a_M}{a_P} = 16\frac{P_M}{P_P},\ \frac{\omega_M}{\omega_P} = 4 \quad (10)$$

This analysis shows that both longitudinal strains and accelerations in membranes are drastically increased if the membrane is loaded by the same force as a plate, while the natural frequency is always larger in membranes than in plates. These are exactly those characteristics needed for efficient dust dislodgment.

Therefore, in order to have the same strains and accelerations as in plate-type ESPs, membranes may be loaded by much smaller forces. This means the rapping apparatus used to produce the desired strains and accelerations can be much less robust, and therefore less expensive, than those required for conventional plates.

Furthermore, because the effects of stiffeners were disregarded in the above analysis, the conclusion is very conservative. If the effects of stiffeners are taken into account, the conclusion is even more in favor of membranes. For example, the total mass of the stiffened plate is almost twice as much as that of a non-stiffened plate. Hence, the acceleration ratio is closer to $a_M/a_P=30P_M/P_P$, almost twice as much as predicted above in Equation (10). A similar conclusion may be reached for strains, since if the stiffeners were included in the above analysis the "equivalent" thickness of the plate, and therefore its stiffness, would be drastically increased along with the strain ratio.

A large number of fiber-based materials are suitable for use as membranes. They include woven mats made from very thin corrosion- resistant fibers, or strands of fibers, as well as very thin and flexible dense screens or meshes made from corrosion-resistant wires. The individual fibers, complete strands made from fibers, or screen wires with small enough openings may be bare or may have some thin coating. The coating may be used in order to protect the fibers from the ambient corrosive conditions, to enhance electrical conductivity of the fibers, or to make the collection surface free of openings.

Fibers can be made from metals. ceramics, polymers, silica, carbon and many other materials. Fibers made of metals and alloys are commonly called wires. Wires and wire meshes have been manufactured for a variety of applications. Such wires and meshes can be used in dry precipitators where temperatures are quite high but corrosion problems are not significant. Screens made from stainless steels resist chemical corrosion and oxidation in temperatures to 1400° F. They are commercially available as a mesh that has 600-by-600 wires per square inch or more, diameter and openings (holes) of the order of 20 $\mu$m, and specific weight less than 0.2 kg/m$^2$. These are to be distinguished from the existing stiffened plates (having a thickness of 1 to 2 mm or more) used in conventional ESPs and having a specific weight of 15–30 kg/m$^2$, which is one order of magnitude more than the specific weight of membranes.

Additionally, over the last decade fibers from non-conventional materials have been developed. These include ceramic fibers (e.g. fibers sold in association with the trademarks NEXTEL, FP, SCS), polymer fibers (e.g. fibers sold in association with the trademarks KEVLAR and SPECTRA), silica fibers and carbon fibers. All of these fibers can be woven into fabric-like materials and used as collection surfaces in the precipitator. For example, ceramic fibers can be used in wet precipitators where severe corrosion problems can occur with other materials. Silica fibers can be used in high temperature applications of more than 1,000° C.

The specific weight of these non-conventional membranes is typically 0.5–1 kg/m$^2$ or less (without framing). For example, Fabric Development Inc., Quakertown, Pa., produces carbon fiber woven mat like the one shown in FIG. 1 with 12,000 fibers (7,$\mu$m diameter) in each tow. The thickness of the tow is less than 1 mm and the specific weight is only 0.661 kg/m$^2$. This means that a 3-by-10 m membrane will weigh only about 20 kg, without the framing. On the other hand a 2 mm thick steel plate of the same dimension weighs about 470 kg, without framing and the stiffeners. Plates in some conventional ESPs are as thick as three to five millimeters.

In general, however, regardless of the material chosen, the membrane material must be corrosion, combustion, mechanical and thermal fatigue resistant, and must have satisfactory electrical conductivity. The current flow in a precipitator is extremely small, so that even a flow of water in the wet electrostatic precipitator provides satisfactory electrical conductivity. The membranes may be made of any material selected from among many candidates. The best choice for any particular circumstances will vary based upon the circumstances. However, the best choices presently for most circumstances seems to be a membrane made from woven strands of coated silica, carbon or ceramic fibers or a mesh of thin stainless steel wires. Of course, many other materials having satisfactory characteristics are contemplated as being useful with the invention.

Composites with a polymer matrix and based on vapor-grown carbon fibers are good candidates since many ESPs operate at moderate temperatures. They have high thermal conductivity and strength and can satisfy the electrical conductivity requirements of the precipitator. The use of carbon fibers, which are produced by a number of different methods, can provide economical and functional advantages. Ceramic fibers have characteristics that may make them preferable for wet ESPs.

Silicones can be a good membrane matrix candidate since carbon-fiber-reinforced silicones can be used continuously at temperatures of about 300° F. Silicones can be produced with the capability of 200% elongation. Therefore, a silicone-based polymer matrix composite may be used to produce composite membranes that can be stretched to dislodge ash particles effectively while still operating at high temperatures. Clearly, other choices for matrices are possible as well.

For higher temperature applications, fibers can be used alone in the form of woven strands. The collector surface roughness does not influence the dust dislodgment efficiency, since the dust layer does not break at the layer-membrane interface. For example, some of the fibers, such as silica, can resist temperatures up to 2,000° F. and can be used in highly corrosive environments. Other carbon fibers are made to work in environments of up to 2000° F., but they are very expensive.

Carbon fibers, either bare or coated, with or without matrix, possess a number of other superior features. Their electrical resistivity ranges from 10 to 100 microOhm-m. Although steel resistivity is typically less than 1 micro Ohm-m, the higher resistivity for fibers is acceptable since the current flow requirement for electrostatic precipitators are very small. Tests conducted at Ohio University have shown that carbon fiber mats are able to collect ash particles by electrostatic precipitation. This is to be expected since even a film of water works as the collection electrode in wet precipitators. Carbon fibers and ceramic fibers are essentially corrosion-free and very resistant to chemical attack. In addition, these fibers have superior fatigue properties, with much higher endurance limits than steels.

Due to its low density ρ and high fatigue endurance limit $\sigma_e$ (defined as the highest allowable stress beyond which the structure is not safe to operate in cyclic loading applied in very large number of cycles, typically $10^6$), fiber-based membranes posses superior properties against fatigue with respect to other possible candidate materials, as illustrated in the following analysis. During the rapping process typical accelerations may reach 200 g's, i.e. about a=2000 m/s$^2$. Hence, the maximum force applied reaches the value $P_{max}$= ma=lbhρ(2000), where l,b,h are the length, width and thickness of the membrane. Since the largest stress must not exceed the endurance limit$\sigma_e$, the maximum allowable loading is $P_{max}=\sigma_e A=\sigma_e bh$, where A is the cross sectional area. Therefore, from the last two equations one finds that $\sigma_e \geqq 2000\, l\rho$. One can then define the fatigue-safety factor as $$f = \frac{\sigma_e}{2000\, l\rho} \geq 1 \tag{11}$$

Typical values for $\sigma_e$ in steels, aluminum alloys and carbons are $5(10)^8$, $1.3(10)^8$ and $1(10)^9$ Pa, while the densities are $7.8(10)^3$, $2.6(10)^3$ and $2(10)^3$ kg/m$^3$, respectively. Hence, the fatigue safety factors, f, for steels and aluminum alloys are about 30/l and 40/l, while for the carbon fibers its value is much higher, about 250/l. For typical lengths l=10–15 m, it is seen that collecting electrodes made of steel or aluminum alloys operate at the safety edge, while carbon-based collectors are safer against fatigue failure.

If membranes are made from corrosion-resistant materials that resist chemical attack by sulfuric acid, such as carbon-based or silica-based composites, the benefits due to this factor alone are numerous. First the possibility of combining dry and wet ESP precipitation is advantageous. This combination should essentially bring the re-entrainment losses to zero. In addition, the aforementioned "electron capture" technique to prevent the gas-to-particle conversion could be implemented, which is of importance in power plants that burn coals with a high sulfur content. With these characteristics, a new ESP using the present invention is capable of meeting the PM2.5 regulation.

Figure 7:
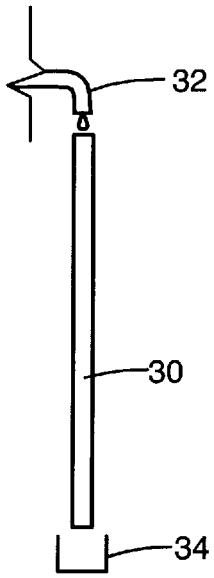
FIG. 7 is a side schematic view illustrating a wet ESP.

In a wet ESP an outer layer of water flows down from the top of a membrane, such as the membrane 30 shown in FIG. 7, and as it flows it collects particles of dust. Water is introduced to the membrane 30 from an applicator 32 near the top of the membrane 30 and flows downwardly into a collector 34 near the bottom of the membrane 30. Because very thin carbon or silica fibers, such as those with a typical diameter of less than 10 microns, have excellent wetting properties the same membranes can be used in dry, wet and hybrid ESPs.

In a wet ESP the water is the conducting collection surface, and therefore, the substrate need not be an electrically conductive material. Additionally, the substrate need not be a membrane because it does not need to be pulled in tension to remove the particulate matter. The flow of water removes the particulate matter. However, the ability of the preferred woven mat of thin carbon, silica or other fibers to be used in both wet and dry applications is an additionally advantage that arises due to its excellent wettability, corrosion resistance, and ability to be pulled in tension. Therefore, one embodiment is a plurality of dry ESP fields followed by a single wet ESP field to reduce re-entrainment. All of the collection substrates are made of the preferred membrane material, but only the dry fields have impulse tensile loads applied periodically.

A number of experiments were conducted on membranes made from different materials at the Russ College of Engineering and Technology of Ohio University.

Among other materials, two different carbon-based woven mats were tested: Fabric 1150 (thickness 0.3 mm, mass 207 g/m$^2$), manufactured by Fabric Development Inc., Quakertown, Pa., and Fabric 3COWCA-7 (thickness 0.36 mm, mass 204 g/m$^2$), manufactured by Amoco Performance Products Inc., Chicago, Ill. In many aspects carbon-fiber-based membranes may be viewed as typical representatives of a number of woven membranes made from a variety of fibers. For that reason some of the basic test results for these two materials are given below.

Tests for determination of electrical resistivity/conductivity have shown that carbon-based woven mats behave as semiconductors and that their resistivity at room temperature is of order $10^{-04}$ Ohm-meters. Although the conductivity can be improved by coating fibers/strands/membranes by more conductive materials, experiments against dust collection efficiency show that this small conductivity is still sufficient for the ESP application. The experiments conducted at elevated temperatures have shown that the resistance is decreased for about 10 percent at ESP operating temperatures (150–200 degrees Centigrade).

Tests of resistance to sulfuric acid, during which the two membrane materials were immersed in a tube that contains 200 ml sulfuric acid with a concentricity of 10 mol/l (i.e. in the environment far more aggressive than in real ESPs), have revealed that the carbon-based membranes have a superior behavior and no loss of weight was recorded.

Testing of wetting properties have shown that the two carbon-based membranes absorb liquids very well and the relative increase of weight after the membranes were dipped into water was increased between 55 and 70%. The results indicate that other fiber-based woven materials most likely have good wetting properties too.

In the experiment of resistance to combustion the two materials were held in a furnace at high temperatures for at least several weeks. These tests show that the Fabric 1150 can resist temperatures up to 450° F., while Fabric 3COWCA-7 can resist temperatures up to 550° F.

Figure 8:
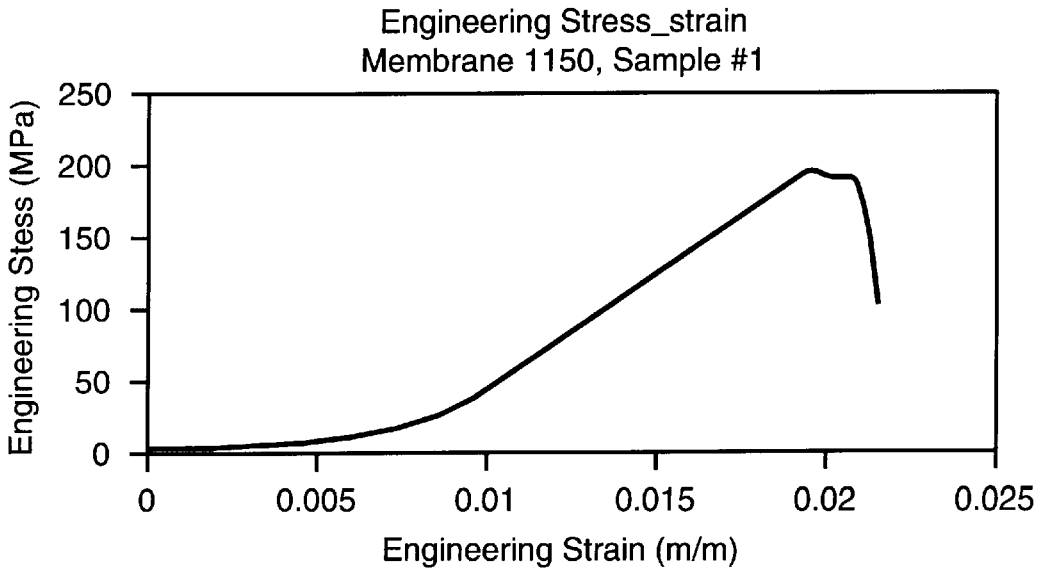
FIG. 8 is a graphical illustration of stress plotted against strain for a carbon-fiber membrane.

In tests on membrane resiliency static-loading response has been measured for both single strands and standard-size (7 in-by-1 in) carbon-fiber membrane specimen using the Tinius-Olsen testing machine. These results are given in FIG. 8 for Fabric 1150 and compared with those of Fabric 3COWCA-7 and SAE 4340 steel in FIG. 9.

Figure 9:
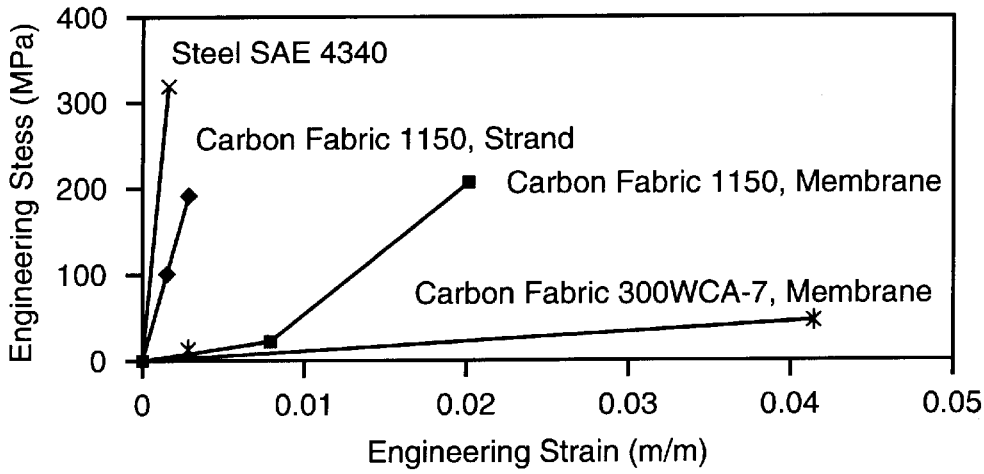
FIG. 9 is a graphical illustration of stress plotted against strain for different materials.

Preliminary results show that the membrane as a structure behaves differently than carbon strands it is made from and is much less stiff. Also, both the strand made from carbon fibers and the membrane made from those strands exhibit much larger strains than the corresponding steel specimens at comparable loading, as shown in FIG. 9. Larger strains are needed in real ESPs because they produce larger shear-off effects in the rapping process of the dust layer. Although the tests were performed on carbon-fiber-based membranes only, it is expected that other fiber-based woven materials, such as silica, will exhibit a similar behavior.

A number of experiments were conducted to determine the dust collecting efficiency of the two woven fabrics made from carbon fibers in order to check if it is possible to collect dusts with carbon-based fabrics in ESPs. The experiment was carried out in the small-size laboratory precipitator shown in FIG. 10.

Figure 10:
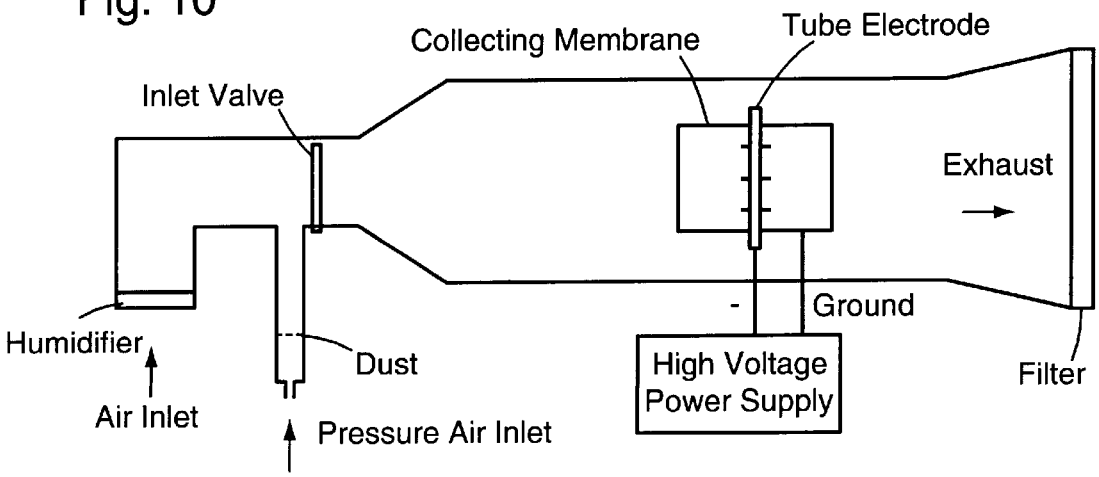
FIG. 10 is a side schematic view illustrating an experimental apparatus.

The precipitator consists of a smooth-wall wind tunnel of circular cross section, as shown in FIG. 10. Ambient air and dust, which are blown up by pressured air, are drawn into the tunnel by a fan, and the air speed of about 1–2 m/s is controlled by the inlet valve. The high voltage is applied by the power supply unit between the vertical tube discharging electrode and the vertical membrane with the tube electrode having a negative polarity and the membrane being grounded. A humidifier, which increases the humidity by letting pressured air bubble in water, is used to maintain the relative humidity above 50%.

The wind tunnel is 60 inches long and 12 inches in diameter. The membrane is 7 inches long and 6.5 inches wide. The tube electrode is made of brass tube with 0.375 inches diameter. Ten spikes, 0.10 inches in diameter 1 inch long, in two rows are connected to the vertical tube to produce strong electric field. The distance between the spikes is 1.25 inches. The tube electrode and the membrane are mounted on a plastic frame. The distance between the electrode and the membrane is 8 inches.

The membrane specimens on which the experiments have been conducted had dimensions 7 inches by 6.25 inches. The experiments were carried out at a room temperature, 20–30° C. with the room humidity ranging from 45% to 55%. The collecting time was 25 minutes.

Roughly 30 experiments were made for the two materials. Since flow-induced vibration may influence dust dislodgment, three different connecting modes were tested, i.e., sewing the membrane with a cotton thread to a non-conductive plastic plate on the back side, as is shown in FIG. 11; gluing it to the plastic plate, as shown in FIG. 12, and with no plate, as shown in FIG. 13.

For carbon Fabric 1150 two collecting states. without plastic plate and with fabric sewed to the plastic plate with cotton thread, were tested. For carbon Fabric 3COWCA-7 only one collecting mode, with fabric glued to the plastic plate, was tested.

The experiment results of Fabric 1150 without plastic plate is shown in FIG. 14. Because the fabric was vibrating due to flow-induced vibration some portion of dust was detached from the membrane. In order to check if it re-entered the flow, a special tray was used to collect the dust below. The tray had several slots, parallel to the flow, each of them 10 mm in width. Although the membrane was not completely taut, its vibration did not push the dust back into the main gas stream and it was evident that all the detached dust remained in the first slot (nearest to the membrane). The average percentage of the dust detached due to vibration was found to be about 22%.

The results of the experiments with Fabric 1150 with plastic plate in the background are shown in FIG. 15. Because of the absence of vibration, there is no dust drop in the slots. The total average dust collected in 25 minutes was 29.41 g, which was about 20% more than when the dust was collected on a loose membrane, without the plastic backing, i.e. in presence of vibration.

Finally, the results of the experiments on the carbon Fabric 3COWCA-7 were obtained in only one state, i.e.. with the fabric glued to the plastic plate. The results are shown in FIG. 16.

Although carbon fibers belong to semiconductors, the experiments have clearly confirmed that membranes made from these fibers collect the dust sufficiently well.

Both membranes were made from carbon fibers with very similar properties. However, the amount of dust they collected was much bigger with Fabric 3COWCA-7 than with Fabric 1150, even when the later was firmly attached to the background plastic plate (and could not vibrate). The main difference between the two fabrics is in density of weaving. Fabric 3COWCA-7 is much denser and it seems that this factor played a major role for its better dust collection efficiency. i.e. not only the current intensity but also its density (current per unit area of membrane) seems to play a very important role.

Different research in ESP involves ammonia injection coupled with a pulsating corona to remove $NO_x$ from the flue gas. This process is complicated by the formation of ammonia sulfate $(NH_4)_2(SO_4)$, which results when the ammonia interacts with the gaseous sulfur present when sulfur bearing coal is burned.

Ammonia sulfate has tremendous adhesive properties at operating temperatures in ESPs, such that it can completely obstruct channels, interfere with operation of mechanical devices and "gum-up" the works. As a result, ammonia addition is done in ESPs only under the most dire of circumstances. At present, this usually happens when the ash resistivity is so low that the ESP will not collect the ash. Ammonia is used to increase the particle's adhesion, thus increase agglomeration.

There is no good method for removing ammonia sulfate from operating ESPs that contain metal parts. Washing the plates will result in significant corrosion when the sulfate is put into solution. In addition, this requires shutting down the operating unit, as water injection (on-line) is typically not possible. This is not the case for a wet precipitator. However, a metal-based wet ESP would suffer from excessive corrosion should ammonia injection be used.

A woven membrane made from Fabric 1150 was tested at Ohio University to see if it could be cleared of accumulated ammonia sulfate. The experiments were conducted on a 7 inch by 7 inch membrane. It was treated by a liquid sulfuric acid (98% mole), followed by dropping a liquid ammonia hydroxide (30% mole.), then dried in the oven at temperature around 200° F. and heated for 10 minutes. Finally it was rinsed for about 5 minutes with water from the top of the membrane with low velocity flow.

It was considered that the fiber weave would hold the ammonia sulfate and not release it, even as the water dissolved the sulfate crystals. However, the tests indicate that a weave of carbon fibers can be easily cleared of almost 100% ammonia sulfate. The experiments have also shown that the carbon membrane is completely resistant to the acidic environment.

While certain preferred embodiments of the present invention have been disclosed in detail, it is to be understood that various modifications may be adopted without departing from the spirit of the invention or scope of the following claims.

What is claimed is:

1. An electrostatic precipitator having a first electrode and a substantially planar oppositely charged electrode substrate onto which particulate matter from a substantially parallel flowing fluid stream is precipitated during operation, the precipitator comprising:

(a) an electrically conductive membrane electrode; and (b) a variable tensile loader connected to the membrane, said loader applying a tensile bias continuously to the membrane during operation, and periodically applying an impulse tensile force of increased magnitude to the membrane to remove particulate matter from the membrane.

2. A precipitator in accordance with claim 1, wherein the membrane comprises a solid sheet.

3. A precipitator in accordance with claim 1, wherein the membrane comprises a plurality of intertwined fibers.

4. A precipitator in accordance with claim 3, further comprising a coating on said fibers.

5. A precipitator in accordance with claim 3, wherein said fibers are randomly oriented.

6. A precipitator in accordance with claim 3, wherein said fibers are woven.

7. A precipitator in accordance with claim 6, wherein said fibers are ceramic.

8. A precipitator in accordance with claim 6, wherein said fibers are metal.

9. A precipitator in accordance with claim 6, wherein said fibers are metal alloy.

10. A precipitator in accordance with claim 6, wherein said fibers are polymer.

11. A precipitator in accordance with claim 6, wherein said fibers are carbon.

12. A precipitator in accordance with claim 11, further comprising a silicone matrix.

13. A precipitator in accordance with claim 1, further comprising a first frame member grippingly mounted to a first edge of the membrane, and a second frame member grippingly mounted to a second edge of the membrane, and wherein said variable tensile loader is connected to one of said frame members.

14. A precipitator in accordance with claim 13, wherein the membrane further comprises a screen made of a plurality of woven wires.

15. In an electrostatic precipitator having first and second oppositely charged electrodes, a method for precipitating particulate matter from a fluid stream onto an electrode substrate, the method comprising:

(a) mounting an electrically conductive substantially planar membrane electrode in a fluid stream substantially parallel to the fluid flow;

(b) applying a tensile bias to the membrane;

(c) applying a greater magnitude impulse tensile force to the membrane for removing particulate matter from the membrane; and then (d) ceasing said impulse tensile force while maintaining said bias.

16. A method in accordance with claim 15, further comprising applying the impulse force for a predetermined time.

17. A method in accordance with claim 16, further comprising repeating steps (c) and (d) at a predetermined frequency.

18. An electrostatic precipitator having a first electrode and a substantially planar, oppositely electrically charged electrode substrate onto which particulate matter from a substantially parallel flowing fluid stream is precipitated during operation, the precipitator comprising:

(a) a fabric membrane electrode of intertwined fibers having wetting properties sufficient to permit absorption of water into the membrane and capillary flow of water through the membrane;

(b) an applicator near a top edge of the membrane for applying water to the membrane, wherein water absorbs into, and flows through, substantially all regions of the membrane; and (c) a collector near a bottom of the membrane for collecting water that flows through the membrane;

wherein substantially all of the particulate matter that is precipitated from the fluid stream is precipitated onto the membrane and is caused, by mixing with the flow of water through the membrane, to be collected with the water in the collector.

19. A precipitator in accordance with claim 18, wherein said fibers are randomly oriented.

20. A precipitator in accordance with claim 18, further comprising a coating on said fibers.

21. A precipitator in accordance with claim 18, wherein said fibers are woven.

22. A precipitator in accordance with claim 21, wherein said fibers are ceramic.

23. A precipitator in accordance with claim 21, wherein said fibers are metal.

24. A precipitator in accordance with claim 21, wherein said fibers are metal alloy.

25. A precipitator in accordance with claim 21, wherein said fibers are polymer.

26. A precipitator in accordance with claim 21, wherein said fibers are carbon.

27. A precipitator in accordance with claim 26, further comprising a silicone matrix.

* * * * *